United States Patent [19]

Sagmiller

[11] 4,065,014

[45] Dec. 27, 1977

[54] SLIPSHEET PALLET TOOL AND METHOD

[76] Inventor: Darrell J. Sagmiller, Rte. 1, Box 114, Cornelius, Oreg. 97113

[21] Appl. No.: 727,226

[22] Filed: Sept. 27, 1976

[51] Int. Cl.[2] ..... B66F 9/12

[52] U.S. Cl. ..... 214/621; 214/8.5 SS; 214/152; 214/750; 254/104

[58] Field of Search ..... 214/8.5 SS, 372, 620, 214/621, 750, 152; 254/104; 294/1 R, 55.5, 86

[56] References Cited

U.S. PATENT DOCUMENTS

| | | | |
|---|---|---|---|
| 1,215,718 | 2/1917 | Salisbury | 214/372 |
| 1,807,128 | 5/1931 | Munoz et al. | 214/372 |
| 3,310,189 | 3/1967 | Vander Wal | 214/620 |
| 3,353,697 | 11/1967 | Martin et al. | 214/620 |
| 3,381,937 | 5/1968 | Zillman | 214/620 X |

*Primary Examiner*—L. J. Paperner
*Attorney, Agent, or Firm*—Chernoff & Vilhauer

[57] ABSTRACT

A tool and method for permitting materials handling trucks of the type having standard forks on the front thereof to lift and handle loads of stacked boxes, sacks or other articles supported at their bottom only by flexible slipsheet pallets. The tool comprises an elongate frame having a pair of forwardly projecting, laterally spaced horizontal plates at the bottom thereof, such plates being ground to a sharply tapered edge at their leading edges. A respective handle is located adjacent each end of the elongate frame for use by a workman in manipulating the tool into a position such that the leading edges of the plates are at least partially inserted beneath an edge of a load-bearing slipsheet pallet while the slipsheet and load are at rest on the floor. The tool has a vertical rear surface for engaging the tips of a pair of standard lift truck forks so that the forks can be used to forcibly push the plates fully beneath the loaded slip sheet so as to be sandwiched between the slipsheet and the floor. At the bottom of the rear surface of the tool at locations directly to the rear of each of the respective forwardly projecting plates, a downwardly cammed surface having at least the width of the lift truck forks is provided. The cammed surface permits the forks to be forcibly inserted beneath the forwardly projecting plates and thus below the slipsheet to permit the forks to operatively engage the underside of the loaded slipsheet and thereby lift the load.

4 Claims, 4 Drawing Figures

FIG. 1
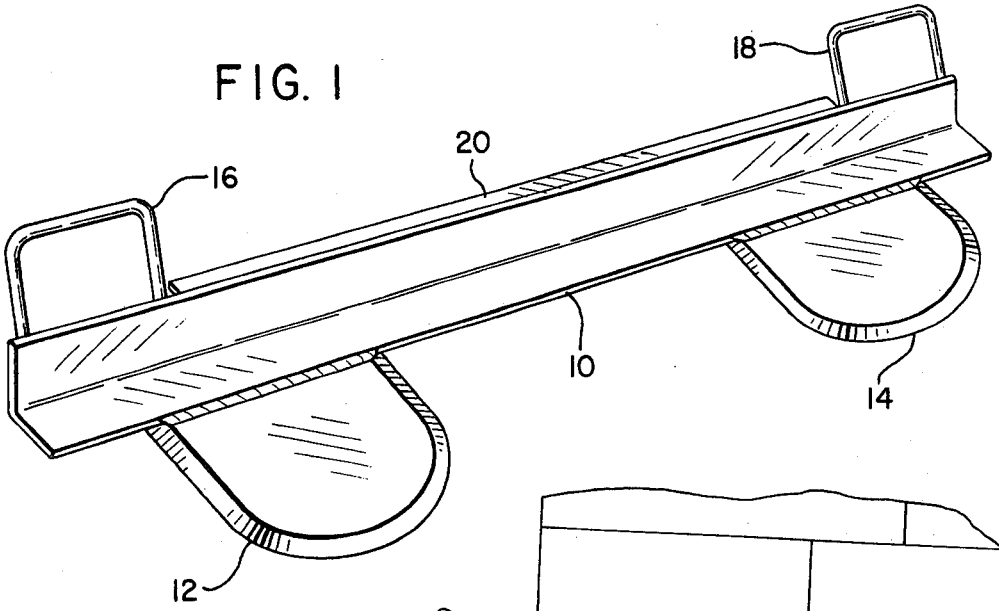
FIG. 4
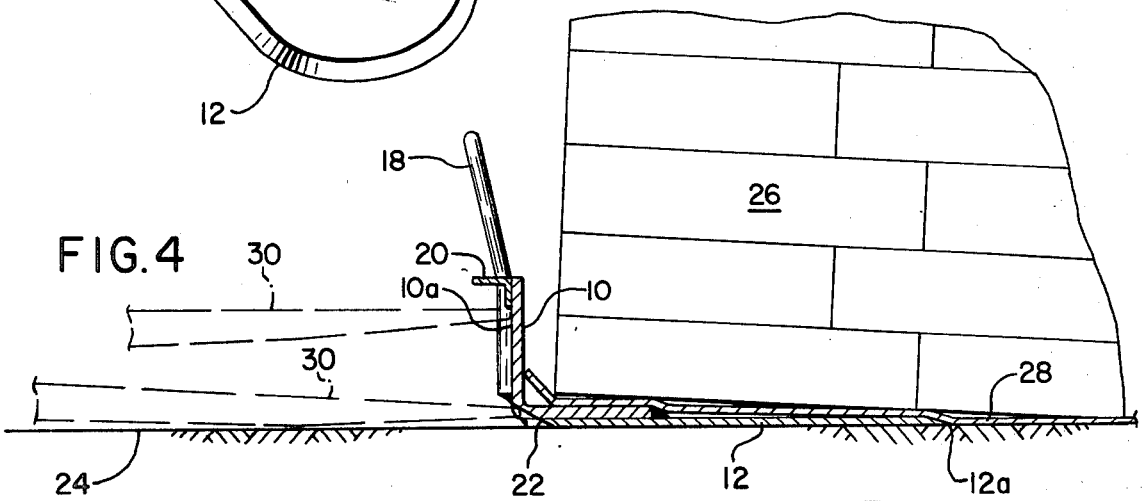
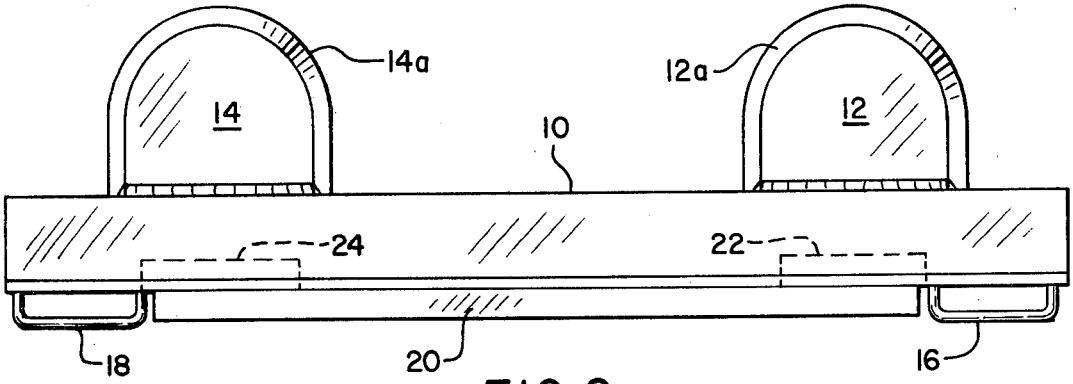
FIG. 2
FIG. 3
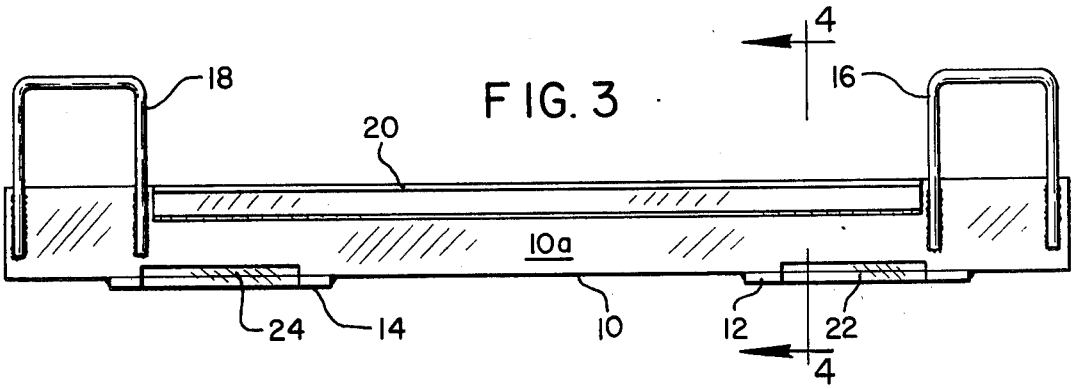

SLIPSHEET PALLET TOOL AND METHOD

BACKGROUND OF THE INVENTION

This invention relates to a tool and method for permitting a materials handling lift truck having standard load handling forks mounted on the front thereof to pick up and handle a load of individual articles stacked atop a slipsheet pallet while the pallet and load are resting directly on a floor with no intervening spacing structure separating the bottom of the slipsheet from the floor.

Slipsheet pallets have gained susbtantial favor in the materials handling industry in recent years because of their economy, lightness and lack of bulk as opposed to wood or metal pallets. The slipsheet pallet normally comprises a thick but flexible sheet of fibrous material having an upwardly bent tab at an edge thereof. Such slipsheets have been designed to be handled by specially equipped forklift trucks having a so-called "push-pull" attachment mounted on the front thereof, such attachment having a remotely controlled retractible clamp for grasping the upturned slipsheet tab and pulling the sheet and thus the load rearwardly and upwardly onto the forwardly extending forks of the truck. Discharge of the load from the forks is accomplished by an extensible push frame which engages the rear of the load and pushes the load and slipsheet forwardly off of the forks when the load is to be deposited.

Such special "push-pull" attachments are sufficiently expensive, and substract sufficiently from the load-carrying capacity of the truck by adding weight to the forward end thereof, that the large majority of forklift trucks presently in operation are not so equipped, but rather are merely equipped with a pair of standard forwardly extending load handling forks (sometimes referred to as "load arms"). When such trucks attempt to handle loads of articles stacked atop slipsheets without a wood or metal pallet being place beneath the slipsheet to provide a space between the floor and the slipsheet into which the forks may be inserted, the truck operator finds that he is unable to insert his forks beneath the load between the slipsheet and the floor and is therefore unable to lift and carry the load. This problem has limited the usage of slipsheet pallets and impaired the space, weight and cost savings which might otherwise be obtainable in the materials handling industry by a more widespread use of such slipsheets.

Accordingly a need exists for a simple tool, which is much less expensive and less complicated than conventional motorized push-pull attachments and causes no impairment of the load lifting capability of the lift truck, for permitting lift trucks having standard load handling forks to operatively pick up and carry loads of articles stacked atop slipsheets where the slipsheets are in direct supportive contact with the floor.

SUMMARY OF THE PRESENT INVENTION

The present invention fulfills the foregoing need by providing a hand-held tool comprising an elongate frame having a pair of laterally spaced, horizontal plates projecting forwardly from the bottom edge of the frame, the leading lateral edges of the plates being tapered to sharp edges of preferably rounded or arcuate lateral shape substantially coincident with the lower surface of the plate. A respective handle is positioned adjacent each end of the frame at the rear thereof for use by a workman in positioning the frame on the floor adjacent one edge of a slipsheet having a load stacked thereon and sliding the sharp leading edges of the plates beneath the edge of the slipsheet. The frame includes a laterally extending upright rear surface having a rearwardly extending flange running along the top thereof for engaging the tips of a lift truck's standard forks, so that the truck by pushing the fork tips forcibly against such surface can push the plates fully beneath the edge of the slipsheet. A pair of laterally spaced, laterally extending forwardly and downwardly inclined cam surfaces are formed at the bottom edge of the rear surface of the frame, each directly at the rear of one of the forwardly projecting plates, and each extending downwardly to a level coincident with the level of the lower surface of the respective plate. The upper edge of the inclined cam surface where it meets the rear surface of the frame is spaced a sufficient vertical distance above the lower surface of the plate as to permit the upper edge of the tip of a standard load handling fork to engage the cam surface when the forwardly projecting plates are beneath the slipsheet. This permits the forks to be brought into contact with the cam surfaces from the rear of the tool and advanced forcibly toward the load, raising the tool and thus the pair of plates and thereby also raising the slipsheet and the load as the forks are advanced. This in turn permits the forks to slip fully beneath the slipsheet and support the load in carrying position. Since the forks are much longer in a forward direction than the plates of the tool, partial withdrawal of the forks from beneath the load automatically withdraws the tool for use with another load, after which the forks may be again fully inserted beneath the load. No special tool is needed to deposit the load once the load has been successfully engaged from below the slipsheet by the forks. It is merely necessary for the operator to deposit the load on the floor and withdraw the forks from beneath the slipsheet, the load and slipsheet remaining in place by frictional engagement with the floor.

It is accordingly a primary objective of the present invention to provide a tool and method whereby a lift truck having merely standard forks may successfully engage and lift a load supported on a slipsheet pallet while the slipsheet is in direct engagement with the floor.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a perspective view of an exemplary embodiment of the slipsheet pallet tool of the present invention.

FIG. 2 is a top view of the tool.

FIG. 3 is a rear view of the tool.

FIG. 4 is a sectional view of the tool taken along line 4–4 of FIG. 3, showing also the tip of a standard lift truck fork in respective alternative positions of engagement with the rear surface of the tool and engagement with the inclined cam surface of the tool.

DESCRIPTION OF THE PREFERRED EMBODIMENT

With reference to the figures, the tool includes an elongate laterally extending frame comprising a steel angle member 10, having a pair of forwardly projecting plates 12 and 14 respectively welded to its lower edge at laterally spaced positions, the upper and lower major surfaces of the plates extending laterally with respect to the frame. Each plate has a lateral leading edge 12*a*, 14*a* respectively tapered to a sharp edge substantially coincident with the bottom surface of the plate, as best seen in FIG. 4 with respect to edge 12*a*. The edges 12*a* and 14*a* are of a laterally rounded or arcuate configuration as depicted in FIGS. 1 and 2 to facilitate insertion beneath a slipsheet, and may, but need not, extend completely along the lateral sides of the plates. Each plate projects approximately six to ten inches forwardly from the leading edge of the elongate angle member 10 and each is relatively thin, i.e. preferably no more than about one-quarter inch in thickness. The lateral width of each plate is preferably about ten inches so as to provide a relatively large upper supporting surface. The lateral center-to-center spacing between the respective plates 12 and 14 is a predetermined spacing coinciding with the center-to-center lateral spacing of the lift truck forks, preferably about 28 inches.

The elongate frame 10 has a vertically oriented rear surface 10*a* extending upwardly from the level at which the plates 12 and 14 are attached to the bottom of the frame 10. Attached to this rear surface, at each end of the frame, is a respective handle 16, 18 by which a workman may grasp the tool and position it relative to a loaded slipsheet. At the top of the rear surface 10*a* is a rearwardly extending flange 20, which may be part of a smaller angle member which is welded to the rear surface 10*a* as shown in the figures. The rearwardly extending flange 20 projects about an inch rearwardly from the rear surface 10*a*.

At the bottom edge of the rear surface 10*a* a pair of forwardly and downwardly inclined cam surfaces 22 and 24 respectively are provided, each being located directly behind and centered upon one of the forwardly projecting plates 12 and 14 so as to have the same center-to-center lateral spacing as the plates and lift truck forks. Each of these cam surfaces has a lateral width greater than the width of the lift truck fork to be used in conjunction with the device, the width of such fork normally being about four inches. For most usages the lateral width of each surface 22 and 24 is preferably about six inches. As seen in FIG. 4, each cam surface such as 22 extends downwardly from an upper level on the rear surface 10*a* of the frame 10 to a level coincident with the lower surface of a respective plate such as 12. The vertical distance between the upper and lower edges of the cam surface is preferably at least about one-half inch, but in any case should be greater than the thickness of the extreme tip of the lift truck fork to be used in conjunction with the tool so as to permit engagement of the top of the fork tip with the cam surface, as will be explained hereafter.

With reference particularly to FIG. 4, to use the tool a workman positions it on the floor 24 such that the lower surfaces of the respective plates 12 and 14 are supported directly by the floor and with the tool centered along the side of a load 26 stacked atop a typical slipsheet pallet 28. The workman then slips the leading edges 12*a* and 14*a* of the plates beneath the edge of the slipsheet 28 and pushes the plates as far underneath the slipsheet as he can manually, which normally will result in only partial insertion of the plates because the weight of the load is substantial. To fully insert the plates beneath the slipsheet to the position shown in FIG. 4, the lift truck approaches the rear side of the tool with its forks lowered and engages the rear surface 10*a* of the tool at a level below the rearwardly extending flange 20 with the tips of its respective forks such as 30 as shown in FIG. 4. The truck then advances toward the load, pushing the tool and thus the plates 12 and 14 further beneath the slipsheet 28. During such pushing, the rearwardly extending flange 20 ensures that the fork tips do not inadvertently slip up over the rear surface 10*a* and gouge the load 26.

After the plates 12 and 14 have thus been fully inserted beneath the slipsheet 28 between the bottom of the slipsheet and floor 24, the forks such as 30 are disengaged from the rear surface 10*a* and lowered further with a slight downward tilt until the fork tips engage the respective cam surfaces 22 and 24, as exemplified by the second position of the fork 30 shown in FIG. 4. The truck is then once more advanced toward the load with the upper surface of the fork tips riding along the cam surfaces 22 and 24 and thereby gradually lifting the plates 12 and 14 and thus the slipsheet 28 and load 26 so as to permit the forks to be inserted below the lower surfaces of the plates 12 and 14. Further advancement of the forks, which are much longer than the forward projection of the plates 12 and 14, past the leading edges 12*a* and 14*a* of the plates permits the forks to be fully inserted below the slipsheet 28 and load 26. Thereafter the truck reverses direction momentarily and withdraws the forks partially. Such partial withdrawal has the effect of withdrawing the plates 12 and 14 from beneath the slipsheet and thereby freeing the tool for other uses. After removal of the tool, the truck advances toward the load thereby fully inserting the forks once more beneath the slipsheet. The fact that the lift truck forks are much longer than the plates 12 and 14 in a forward direction allows this partial withdrawal of the forks and removal of the tool while maintaining sufficient insertion of the forks beneath the slipsheet that the forks may once again be fully inserted after the tool is removed.

The truck may then lift the load to a carrying position, transport the load elsewhere and deposit it. To deposit the load, the truck merely lowers the forks into contact with the floor and then withdraws the forks from beneath the slipsheet, the frictional contact of the loaded slipsheet with the floor being sufficient to prevent movement of the slipsheet and load as the forks are being withdrawn from beneath it.

The terms and expressions which have been employed in the foregoing abstract and specification are used therein as terms of description and not of limitation, and there is no intention, in the use of such terms and expressions, of excluding equivalents of the features shown and described or portions thereof, it being recognized the scope of the invention is defined and limited only by the claims which follow.

What is claimed is:

1. A hand-held tool for enabling a pair of lift truck forks to operatively engage and lift a load while said load is stacked on a slipsheet resting directly on a floor, said tool comprising:

a. a laterally extending elongate frame;

b. a pair of plates, having upper and lower major surfaces, attached to said frame at laterally spaced positions along the length of said frame and projecting forwardly from the bottom of said frame in a direction perpendicular to the length of said frame for inserting beneath said slipsheet, said major surfaces of each said projecting plate extending laterally with respect to said frame;

c. a generally laterally extending leading edge on the forwardly projecting portion of each of said plates, each said leading edge being tapered forwardly and downwardly from the upper surface of said plate toward the lower surface thereof so as to form a sharp edge substantially coincident with the lower surface of said respective plate;

d. a pair of laterally spaced, laterally extending cam surfaces, each of said cam surfaces being connected to the rear of a respective one of said plates and being inclined forwardly and downwardly to a level coincident with the lower surface of said plate for engagement by said lift truck forks;

e. a laterally extending rear surface of said frame extending vertically upward from the rear of said plates for engagement by said lift truck forks to push said plates beneath said slipsheet; and f. means extending rearwardly from the top of said rear surface of said frame for preventing said forks from disengaging upwardly from said rear surface.

2. The tool of claim 1, further including a respective handle adjacent each end of said frame for grasping so as to position said frame and plates with respect to said slipsheet.

3. The tool of claim 1 wherein each of said tapered leading edges of said plates has a laterally extending arcuate shape.

4. A method of engaging and lifting a load by means of a pair of lift truck forks while said load is stacked on a slipsheet resting directly on a floor, said method comprising:

a. inserting a pair of laterally spaced plates beneath an edge of said slipsheet so that said plates partially underlie said load, each of said plates having a generally laterally extending leading edge tapered forwardly and downwardly from the upper surface of said plate toward the lower surface thereof so as to form a sharp edge substantially coincident with the lower surface of said respective plate and each of said plates having a laterally extending cam surface connected to the rear thereof, such cam surface being inclined forwardly and downwardly to a level coincident with the lower surface of said plate;

b. bringing the tips of said lift truck forks into engagement with said cam surfaces and advancing said forks beneath said plate to positions underlying said slipsheet and load;

c. while said slipsheet continues resting on said floor, withdrawing said forks partially from beneath said load and thereby withdrawing said plates from beneath said load;

d. thereafter advancing said forks beneath said slipsheet and lifting said load.

* * * * *